US011920472B2

(12) United States Patent
Gao et al.

(10) Patent No.: US 11,920,472 B2
(45) Date of Patent: Mar. 5, 2024

(54) REASONABLE MILLISECOND TIME CONTROL METHOD FOR EXCAVATION BLASTING OF TUNNEL

(71) Applicants: China Railway Eleventh Bureau Group Co., Ltd, Wuhan (CN); China Railway Eleventh Bureau Group Fourth Engineering Co., Ltd., Wuhan (CN); Wujiu Railway Passenger Dedicated Line Hubei Co., Ltd, Wuhan (CN); China Railway Fourth Bureau Group Co., Ltd, Hefei (CN); Anhui China Railway Engineering Technology Service Co., Ltd, Hefei (CN); Wuhan Institute of Geotechnical Mechanics, Chinese Academy of Sciences, Wuhan (CN); China Railway Southwest Scientific Research Institute Co., Ltd, Chengdu (CN)

(72) Inventors: Jun Gao, Wuhan (CN); Liyun Yang, Beijing (CN); Xiao Lin, Wuhan (CN); Ming Zhang, Wuhan (CN); kaiwen Liu, Beijing (CN); Xiaowei Zuo, Wuhan (CN); Bin Zhou, Wuhan (CN); Feng Wang, Wuhan (CN); Yuxin Gao, Wuhan (CN); Dan Xu, Wuhan (CN); Ling Wang, Wuhan (CN); Zhengyi Wang, Wuhan (CN); Xiaokai Wen, Wuhan (CN); Yongtai Wang, Wuhan (CN); Huiling Xue, Wuhan (CN)

(73) Assignees: CHINA RAILWAY ELEVENTH BUREAU GROUP CO., LTD, Wuhan (CN); CHINA RAILWAY ELEVENTH BUREAU GROUP FOURTH ENGINEERING CO., LTD., Wuhan (CN); WUJIU RAILWAY PASSENGER DEDICATED LINE HUBEI CO., LTD, Wuhan (CN); CHINA RAILWAY FOURTH BUREAU GROUP CO., LTD, Hefei (CN); ANHUI CHINA RAILWAY ENGINEERING TECHNOLOGY SERVICE CO., LTD, Hefei (CN); WUHAN INSTITUTE OF GEOTECHNICAL MECHANICS, CHINESE ACADEMY OF SCIENCES, Wuhan (CN); CHINA RAILWAY SOUTHWEST SCIENTIFIC RESEARCH INSTITUTE CO., LTD, Chengdu (CN)

( * ) Notice: Subject to any disclaimer, the term of this patent is extended or adjusted under 35 U.S.C. 154(b) by 0 days.

(21) Appl. No.: 18/370,567

(22) Filed: Sep. 20, 2023

(65) Prior Publication Data

US 2024/0035381 A1 Feb. 1, 2024

Related U.S. Application Data

(63) Continuation of application No. PCT/CN2023/099346, filed on Jun. 9, 2023.

(30) Foreign Application Priority Data

Jul. 26, 2022 (CN) ..... 202210882101.0

(51) Int. Cl.
*E21D 9/00* (2006.01)

(52) U.S. Cl.
CPC ..... *E21D 9/006* (2013.01)

(58) Field of Classification Search
CPC . E21D 9/006; E21D 9/003; F42D 3/04; E21C 37/14; E21F 17/00
See application file for complete search history.

(56) References Cited

U.S. PATENT DOCUMENTS 3,973,497 A * 8/1976 Coursen ..... E21D 9/006 299/13
4,527,482 A * 7/1985 Hynes ..... F42B 3/26 102/318

(Continued)

FOREIGN PATENT DOCUMENTS

CN 102506622 A * 6/2012
CN 107941104 A 4/2018
CN 109188521 B * 3/2020 ..... G01V 1/307

*Primary Examiner* — Benjamin F Fiorello
(74) *Attorney, Agent, or Firm* — WPAT, PC

(57) ABSTRACT

A reasonable millisecond time control method for excavation blasting of a tunnel is provided, and includes: acquiring physical mechanical parameters to establish a millisecond blasting model, and designing four dimensions blasting parameters of explosive quantity, hole number, inter-hole millisecond and inter-row millisecond; simulating, based on the millisecond blasting model, a blasting process of an explosive package using blasting parameters to obtain a blasting vibration curve; obtaining single-hole blasting vibration waveforms, solving a vibration synthesis curve through a vibration synthesis theory; comparing the vibration synthesis curve with the blasting vibration curve to obtain a coupling relationship of blasting parameters; determining a target group of explosive quantity and hole numbers, determining a target millisecond through the coupling relationship of blasting parameters, and relating a millisecond blasting control strategy to control, and it is used for tunneling project to reduce cut blasting vibration intensity and achieve precise and intelligent control of millisecond blasting.

8 Claims, 2 Drawing Sheets

(56) References Cited

U.S. PATENT DOCUMENTS

| | | | | |
|---|---|---|---|---|
| 2003/0019383 | A1* | 1/2003 | Yoon | E21C 37/16 102/312 |
| 2005/0263027 | A1* | 12/2005 | Johnston | F42D 3/04 102/200 |
| 2014/0139007 | A1* | 5/2014 | Muona | E21D 9/006 299/1.8 |
| 2020/0250355 | A1* | 8/2020 | Giltner | G06Q 50/02 |
| 2023/0089887 | A1* | 3/2023 | Giltner | E21C 37/16 703/1 |

* cited by examiner

REASONABLE MILLISECOND TIME CONTROL METHOD FOR EXCAVATION BLASTING OF TUNNEL

TECHNICAL FIELD

The disclosure relates to the field of tunneling blasting technologies, and more particularly to a reasonable millisecond time control method for excavation blasting of a tunnel.

BACKGROUND

Tunnel is an important and key project for constructing highway and railway. With a development of railway construction and an improvement of science, tunnel excavation methods obtain a booming development. At present, a millisecond blasting technology is extensively used for various blasting projects. A main principle of the millisecond blasting technology is to control adjacent blast holes to blast sequentially at a certain time interval, make blasting seismic waves generated by the blast holes interfere with each other, weaken a vibration velocity of a medium particle, and improve an energy utilization rate of blasting. With a study and use of high-precision detonators in recent years, an actual blasting delay time of the blast holes can be more accurately close to a design value, so as to make the millisecond blasting technology can be more effective and accurate to enable that the various blasting project can achieve an expectant blasting effect. Compared with simultaneous blasting, the millisecond blasting technology divides a total explosive quantity of one blasting into multiple blasting, which can improve the blasting effect and reduce blast vibration damages.

An effect of the millisecond blasting relates to factors such as a disposition manner of the blast holes, condition of surrounding rock and condition of geological, and selection of a millisecond time is a core of the millisecond blasting technology. For years a study of reasonable delay time in the millisecond blasting technology of tunnels is small, and the millisecond time is selected mostly depending on engineering experience, therefore, there are often situations where the blasting effect is not ideal in tunneling projects. Thus, how to consider reasonable millisecond time and its control method is of great significance.

SUMMARY

The disclosure provides a reasonable millisecond time control method for excavation blasting of a tunnel, a blasting vibration curve is obtained by establishing a millisecond blasting model and simulating a blasting process of an explosive package in the tunnel, and the blasting vibration curve is compared with a vibration synthesis curve synthesized by measured single-hole blasting vibration waveforms to analyze a coupling relationship of multi-dimensional blasting parameters, and explore a relating law of the multi-dimensional blasting parameters; furthermore, a target millisecond is solved and related to a control strategy of millisecond blasting; and the control strategy of millisecond blasting can be used for tunneling projects, and it is beneficial for controlling a blasting vibration intensity, and reducing a damage of blasting vibration to buildings, so as to achieve a reasonable millisecond time control.

Technical solutions of the disclosure are as follows.

A reasonable millisecond time control method for excavation blasting of a tunnel is provided, and includes:

step 1: acquiring physical and mechanical parameters of a rock on an excavation tunneling working face of the tunnel, establishing a millisecond blasting model according to the physical and mechanical parameters, and designing four different dimensions of blasting parameters of explosive quantity, a hole number, an inter-hole millisecond and an inter-row millisecond;

step 2: simulating, based on the millisecond blasting model, a blasting process of an explosive package in the tunnel using the blasting parameters, to obtain a blasting vibration curve;

step 3: obtaining single-hole blasting vibration waveforms of the tunnel, and solving a vibration synthesis curve according to the single-hole blasting vibration waveforms of the tunnel by using a vibration synthesis theory;

step 4: comparing the vibration synthesis curve with the blasting vibration curve to obtain a coupling relationship of the blasting parameters; and step 5: determining a target group of a single-hole explosive quantity and the hole number, determining a target millisecond based on the coupling relationship of the blasting parameters, and relating the target millisecond with a control strategy of millisecond blasting for controlling.

In an embodiment, the physical and mechanical parameters include a rock density, a uniaxial compression, a Poisson's ratio and an elastic modulus.

In an embodiment, the establishing a millisecond blasting model, includes: establishing an explosive model, a rock model and an air composition material model by using an ANSYS software; where a size of the explosive model is 8 centimeters (cm)×12 cm×1000 cm, and a size of the rock model is 5 meters (m)×10 m×15 m; a surface of the explosive module in contacted with the rock model is constrained by a symmetrical plane constraint condition, a side face of the explosive model is constrained by a non-reflecting boundary condition, and a top of the explosive model is constrained by a restraint condition set based on a vertical stress of a ground building.

In an embodiment, the designing four different dimensions of blasting parameters of explosive quantity, a hole number, an inter-hole millisecond and an inter-row millisecond, includes: obtain groups of the four dimensions of blasting parameters by using a response surface methodology.

In an embodiment, the step 2 includes: simulating a rock and air by using a Lagrange method, and simulating an explosive movement by using any one of Lagrangian-Eulerian methods; simulating an explosion field by using a motion equation of inviscid compressible fluid; and obtaining vibration velocities of multiple observation points of the millisecond blasting model, and performing numerical simulation calculation on the vibration velocities to obtain the blasting vibration curve.

In an embodiment, the step 3 includes:

fitting the single-hole blasting vibration waveforms to obtain a single-hole waveform fitting function, where, a formula of the single-hole waveform fitting function is as follows:

$$f(t) = a_0 + \sum_{i=0}^{k}(a_j \cos i\omega t + b_j \sin i\omega t);$$

extending the single-hole waveform fitting function based on a single-hole waveform truncation time to obtain a time domain waveform fitting function, where a formula of the time domain waveform fitting function is as follows:

$$v(t) = \begin{cases} 0 & t < 0 \\ f(t) & 0 \le t \le T \\ 0 & T < t \end{cases};$$

where f(t) represents the single-hole waveform fitting function, t represents time, $a_0$, $a_i$, and $b_i$ represent fitting coefficients, co represents a fundamental frequency, k represents a fitting series, a curve fitting calculation is controlled by the fitting series k, a value of k is adjusted according to a waveform fitting accuracy, v(t) represents the time domain waveform fitting function, and T represents the single-hole waveform truncation time; and performing a linear superposition calculation on the groups of the four dimensions of blasting parameters to obtain the vibration synthesis curve.

In an embodiment, the step 4 includes: performing mode decomposition of the vibration synthesis curve and the blasting vibration curve to obtain decomposed vibration signals; and calculating information gains of the decomposed vibration signals, and using the information gains as coupling coefficients to obtain a coupling relationship matrix.

In an embodiment, the step 5 includes: screening out a target blasting parameter set based on the blasting vibration curve of the step 2 and using a safety vibration velocity as a restraint condition, and determining a target group of the single-hole explosive quantity and the hole number according to a size of the excavation working surface of the tunnel and the target blasting parameter set; obtaining a vibration synthesis curve corresponding to the target group of the single hole explosive quantity and the hole number, and reconstructing the vibration synthesis curve corresponding to the target group of the single-hole explosive quantity and the hole number by using the coupling relationship matrix, to obtain a blasting fitting curve; and analyzing, based on an interference vibration reduction theory with an effect subtraction in a half main waveform period, a blasting vibration attenuation law of different combinations of inter-hole milliseconds and inter-row milliseconds, to determine a target millisecond, and determining a control strategy for millisecond blasting based on the target millisecond.

In an embodiment, the determining a control strategy for the millisecond blasting includes one of the following steps:

adopting a segmented millisecond blasting technology to blast the rock when one of $t_1>\gamma_1$, and $t_2>\gamma_2$ or $t_1<\gamma_1$, and $t_2<\gamma_2$ is satisfied;

adopting a continuous charge millisecond blasting technology to blast the rock when $t_1>\gamma_1$, and $t_2<\gamma_2$ or $t_1<\gamma_1$, and $t_2>\gamma_2$ is satisfied.

In an embodiment, in a situation that the segmented millisecond blasting technology is adopted, an interval charging manner is used for a blast hole, an explosive is divided into two sections for charging with the two-section explosives having a same length, the two-section explosives are delay-blasted by a digital electronic detonator in different time periods, and a blasting time of a lower section of the two sections is delayed by 5-10 milliseconds (ms) compared to an upper section of the two sections; and in a situation that the continuous charge millisecond blasting technology is adopted, a diameter of the explosive is smaller than a diameter of the blast hole, a gap is defined between the explosive and a wall of the blast hole, the explosive is continuously loaded into the blast hole and is not separated, and the explosive is delay-blasted by the digital electronic detonator.

Beneficial effects of the disclosure are as follows.

1. The disclosure provides a reasonable millisecond time control method for excavation blasting of a tunnel, the blasting vibration curve is obtained by establishing the millisecond blasting model and simulating the blasting process of the explosive package in the tunnel, and the blasting vibration curve is compared with the vibration synthesis curve synthesized by the measured single-hole blasting vibration waveforms to analyze the coupling relationship of the multi-dimensional blasting parameters, and explore the relating law of the multi-dimensional blasting parameters, furthermore, the target millisecond is solved and related to the control strategy of millisecond blasting, the control strategy of millisecond blasting can be used for tunneling projects, and it is beneficial for controlling the blasting vibration intensity, and reducing the damage of blasting vibration to buildings, so as to achieve the reasonable millisecond time control.
2. The disclosure provides a reasonable millisecond time control method for excavation blasting of a tunnel, the millisecond blasting model is established by acquiring the physical and mechanical parameters, an applicability of project is fully considered, the top of the millisecond blasting model is constrained by a restraint condition set based on the vertical stress of the ground building, an influence of ground stress is considered, and the model has high fit and strong applicability.

DETAILED DESCRIPTION OF EMBODIMENTS

The follows explain implementation methods of the disclosure by specific embodiments, those skilled in the art can easily understand other advantages and effects of the disclosure through contents disclosed in the specification. Obviously, the described embodiments are merely some embodiments of the disclosure, not all of them. Based on the embodiments of the disclosure, those skilled in the art obtains other embodiments without creative works are all within a scope of protection of the disclosure.

It should be noted that description in the disclosure, terms "middle", "up", "down", "horizontal", "within" and the like indicate orientation or positional relationships based on the orientation or positional relationships shown in drawings and are intended merely to facilitate the description of the disclosure, not to indicate or imply that the device or element referred thereto must have a particular orientation or be constructed and operated in a particular orientation, and therefore are not to be construed as limiting the disclosure. Moreover, terms "first", "second" are merely used for describing purposes and can be not understood to indicate or imply relative importance.

Moreover, it should be noted that description in the disclosure, unless otherwise specified and limited, the terms "dispose", "install", "connect", "couple" and other terms should be understood in a broad sense. For example, it can be a fixed connection, a detachable connection, or an integrally formed; it can be a mechanical connection; it can be a direct connection or an indirect connection through an intermediate medium, it can be an internal communication between two components. For those skilled in the art, specific means of the above terms in the disclosure can be understood according to specific conditions.

Figure 1:
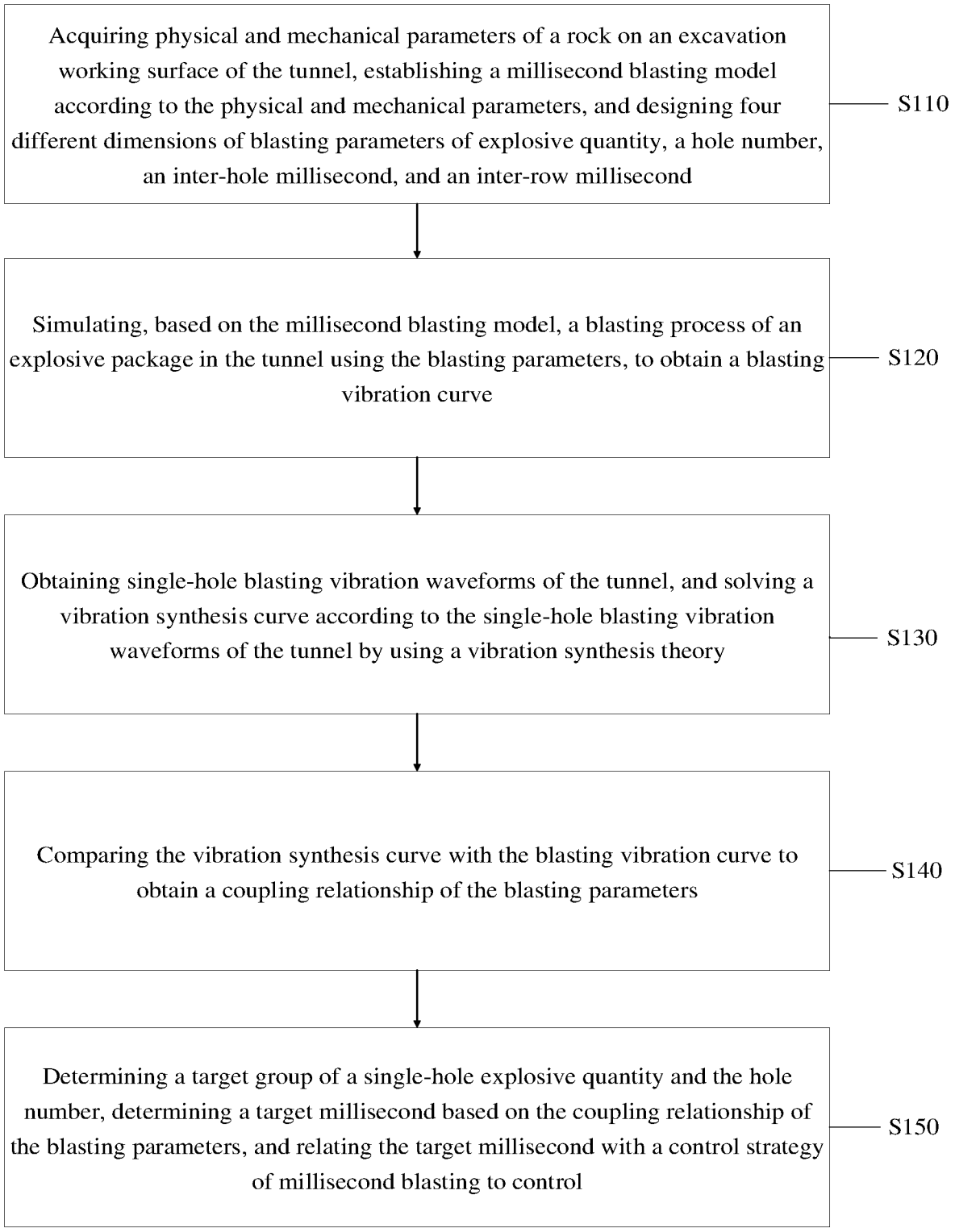
FIG. 1 illustrates a flowchart of a reasonable millisecond time control method for excavation blasting of a tunnel according to an embodiment of the disclosure.
Figure 2:
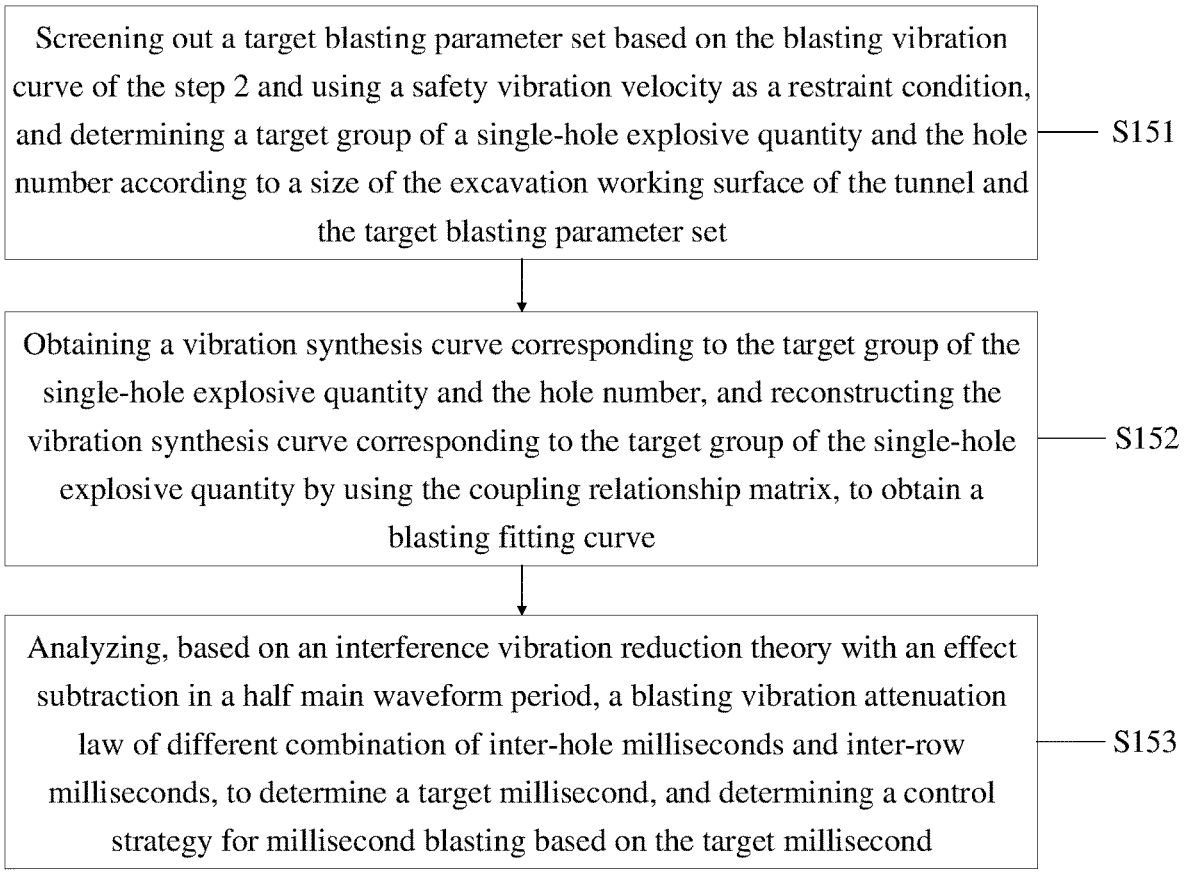
FIG. 2 illustrates a detail flowchart of step S150 as shown in FIG. 1 of a reasonable millisecond time control method for excavation blasting of a tunnel according to an embodiment of the disclosure.

As shown in FIG. 1, a reasonable millisecond time control method for excavation blasting of a tunnel is provided, and the method may include the following steps S110-S150.

In step S110, physical and mechanical parameters of a rock on an excavation working face of the tunnel are acquired, a millisecond blasting model is established according to the physical and mechanical parameters, and four different dimensions of blasting parameters of explosive quantity, a hole number, an inter-hole millisecond and an inter-row millisecond are designed.

Rock masses in nature are anisotropic, discontinuous and inhomogeneous media, a typical rock granite is selected as a propagation medium in the embodiments, an elastoplastic material model is used, some physical and mechanical parameters of the rock are used to describe properties of materials in the model during a model establishment process, specifically, the physical and mechanical parameters include a rock density, a uniaxial compression, a Poisson's ratio and an elastic modulus. In order to obtain required experimental parameters, acquired rock samples are performed sample processing according to experimental methods required in literatures such as "Recommended Methods for Rock mechanics Test" and an industry standard "Specifications for rock tests in water conservancy and hydroelectric engineering (SL264-2001)", the Poisson's ratio and the rock density of each sample are respectively calculated by measuring a size and a mass of each sample, mechanical parameters of the rock masses are measured by using a rock mechanics test (RMT)-150C rock mechanics test loading system.

An establishment method of the millisecond blasting model is as follows. An ANSYS software is used for establishing an explosive model, a rock model and an air composition material model, specifically, a size of the explosive model is 8 centimeters (cm)×12 cm×1000 cm, a size of the rock model is 5 meters (m)×10 m×15 m, a surface of the explosive module in contacted with the rock model is constrained by a symmetrical plane constraint condition, a side face of the explosive model is constrained by a non-reflecting boundary condition, and a top of the explosive model is constrained by a restraint condition set based on a vertical stress of a ground building.

In an embodiment, the rock model is used, and the millisecond blasting model is established by acquiring the physical and mechanical parameters, an applicability of project is fully considered, the top of the millisecond blasting model is constrained by a restraint condition set based on the vertical stress of the ground building, an influence of ground stress is considered, and the model has high fit and strong applicability. In the embodiment, a resume physical and mechanical model is analyzed from a physical process of blasting effect and a rock breaking mechanism, which can determine that an improvement of a crushing effect of the millisecond blasting, a role of stress wave superposition and fully utilized explosive gases, and generation of new free surfaces and enhance fragmentation of reflect tensile waves are unified, so as to further enhance a fragmentation for media.

In step S120, a blasting process of an explosive package in the tunnel using the blasting parameters is simulated based on the millisecond blasting model, to obtain a blasting vibration curve.

Specifically, in step S120, a Lagrange method is used to simulate a rock and air, and any one of Lagrangian-Eulerian methods is used to simulate an explosive movement; a motion equation of inviscid compressible fluid is used to simulate an explosion field, and vibration velocities of multiple observation points of the millisecond blasting model are obtained, and numerical simulation calculation on the vibration velocities is performed to obtain the blasting vibration curve.

In step S130, single-hole blasting vibration waveforms of the tunnel are obtained, and a vibration synthesis curve is solved according to the single-hole blasting vibration waveforms of the tunnel by using a vibration synthesis theory.

The single-hole blasting vibration waveforms is fitted to obtain a single-hole waveform fitting function, and a formula of the single-hole waveform fitting function is as follows:

$$f(t) = a_0 + \sum_{i=0}^{k} (a_i \cos i\omega t + b_i \sin i\omega t).$$

Formulas of parameters are as follows:

$$a_0 = \frac{1}{L}\sum_{l-1}^{L} g_c;$$
$$a_i = \frac{2}{L}\sum_{l=1}^{L} g_c \cos\frac{2\pi i(l-1)}{L};$$
$$b_i = \frac{2}{L}\sum_{l=1}^{L} g_c \sin\frac{2\pi i(l-1)}{L};$$
$$\omega = 2\pi/T.$$

The single-hole waveform fitting function is extended based on a single-hole waveform truncation time, to obtain a time domain waveform fitting function, and a formula of the time domain waveform fitting function is as follows:

$$v(t) = \begin{cases} 0 & t < 0 \\ f(t) & 0 \le t \le T \\ 0 & T < t \end{cases}.$$

Where f (t) represents the single-hole waveform fitting function, t represents time, $a_0$, $a_i$, and $b_i$ represent fitting coefficients, ω represents a fundamental frequency, k represents a fitting series, a curve fitting calculation is controlled by the fitting series k, a value of k is adjusted according to a waveform fitting accuracy, v(t) represents the time domain waveform fitting function, T represents the single-hole waveform truncation time; g c represents a c-th sample value, and L represents a total sampling points.

A linear superposition calculation is performed on the groups of the four dimensions of blasting parameters to obtain the vibration synthesis curve, specifically, the groups of the four dimensions of blasting parameters includes: four different dimensions of blasting parameters of explosive quantity, a hole number, an inter-hole millisecond and an inter-row millisecond.

In an embodiment, the four dimensions of blasting parameters are used for performing the linear superposition calculation, different blasting methods and plans are specifically reflected and accurately explained, a parameter of each indicator of a corresponding drilling and blasting technology is used. The parameters include various parameters such as drilling parameters (i.e., hole pattern parameters), that is hole depth, bore diameter, array pitch (i.e., minimum resistance line) and hole spacing; charge parameters include charge length, package diameter and density and interval charge, and the charge parameters are used for explaining a specific form of charge; blasting parameters include number of detonation stages, time difference of each stage, propagation length and blasting range; parameters with one dimension include charge coefficient, decoupling coefficient, density coefficient of blasthole; relative power coefficient and parameters relate to management. Different blasting methods have corresponding parameters. When designing blasting, parameter design or selection are strived for reasonable and reliable to achieve matching and obtain a good blasting effect.

In step S140, the vibration synthesis curve is compared with the blasting vibration curve to obtain a coupling relationship of the blasting parameters.

Mode decomposition is performed on the vibration synthesis curve and the blasting vibration curve to obtain decomposed vibration signals, and information gains of the decomposed vibration signals are calculated and the information gains are used as coupling coefficients to obtain a coupling relationship matrix.

A formula of the coupling coefficients is as follows:

$$Q(X, Y) = -\sum_{m=1}^{x}\sum_{n=1}^{y} x_{mn}\log_2 x_{mn}.$$

Where Q(X,Y) represents the information gains that is the coupling coefficients, X represents an information component set of the vibration synthesis curve, Y represents an information component of the blasting vibration curve, $x_{mn}$ represents a $m^{th}$ component state of X, and a probability of $n^{th}$ component state of Y, the smaller the information gains, the stronger the coupling relationship.

In step S150 a target group of the single-hole explosive quantity and the hole number is determined, a target millisecond is determined based on the coupling relationship of the blasting parameters, and a control strategy of millisecond blasting is related with the target millisecond for controlling.

Specifically, the step S150 includes the following steps S151-S153.

In step S151, a target blasting parameter set is screened out using a safety vibration velocity as a restraint condition and based on the blasting vibration curve of the step 120, and a target group of the single-hole explosive quantity and the hole number is determined according to a size of the excavation working surface of the tunnel and the target blasting parameter set.

In step S152, a vibration synthesis curve corresponding to the target group of the single-hole explosive quantity and the hole number is obtained and the vibration synthesis curve corresponding to the target group of the single-hole explosive quantity and the hole number is reconstructed by using the coupling relationship matrix to obtain a blasting fitting curve.

In step S153, a blasting vibration attenuation law of different combinations of inter-hole milliseconds and inter-row milliseconds is analyzed based on an interference vibration reduction theory with an effect subtraction in a half main waveform period, to determine a target millisecond, and the control strategy for millisecond blasting is determined based on the target millisecond.

In an embodiment, the determining a control strategy for millisecond blasting includes one of the following steps: a segmented millisecond blasting technology is adopted to blast the rock when one of $t_1>\gamma_1$, and $t_2>\gamma_2$ or $t_1<\gamma_1$, and $t_2<\gamma_2$ is satisfied; and a continuous charge millisecond blasting technology is adopted to blast the rock when one of $t_1>\gamma_1$, and $t_2<\gamma_2$ or $t_1<\gamma_1$, and $t_2>\gamma_2$ is satisfied.

In an embodiment, $\gamma_1 \in$ (10 ms-20 ms), and $\gamma_2 \in$ (50 ms-70 ms).

Specifically, when the segmented millisecond blasting technology is adopted, an interval charging manner is used for a blast hole, an explosive is divided into two sections for charging with the two-section explosives having a same length, the two-section explosives are delay-blasted by a digital electronic detonator in different time periods, and a blasting time of a lower section of the two sections is delayed by 5-10 milliseconds (ms) compared to an upper section of the two sections; and the continuous charge millisecond blasting technology is adopted, a diameter of the explosive is smaller than a diameter of the blast hole, a gap is defined between the explosive and a wall of the blast hole, the explosive is continuously loaded into the blast hole and is not separated, and the explosive is delay-blasted by the digital electronic detonator.

The segmented millisecond blasting technology uses the digital electronic detonators to accurately control the millisecond time for segmenting blasting in the blast hole. When the inter-hole millisecond and inter-row millisecond are bigger or smaller, a free-face is provided for surrounding rocks through a micro delay detonation of the upper section of the two sections and the lower section of the two sections, thus greatly reducing the blasting vibration. When difference between the inter-hole millisecond and the inter-row millisecond is larger, the continuous charge millisecond blasting technology is used to make the explosive fully blasting and improving an energy utilization rate.

In order to verify an effect of the embodiments in the disclosure, the following experience is used for performing effectiveness evaluation.

Specifically, 24 blasting experimental areas are established, a hole number is 1562 in total (424 water holes, 1141 dry holes), a total blasting amount is 1.542 million tons, and a comparison of a blasting vibration intensity of an industrial blasting method and the method in the embodiment of the disclosure is shown in Table 1.

TABLE 1

Comparison table of blasting vibration velocity

| | Blasting vibration speed (cm/s) | Distance from blasting source (m) | Explosive quantity in blasthole (kg) | Blasthole depth (m/s) | Delay time (ms) |
|---|---|---|---|---|---|
| Industrial blasting method | 3.2 | 0.6 | 0.9 | 2.5 | 650 |
| Method in the embodiment | 0.8 | 0.6 | 0.8 | 2.5 | 190 |

As shown in Table 1, technical solutions provided in the embodiments of the disclosure include the following technical effects and advantages.

The disclosure obtains the blasting vibration curve by establishing the millisecond blasting model and simulating the blasting process of the explosive package in the tunnel, and the blasting vibration curve is compared with the vibration synthesis curve synthesized by the measured single-hole blasting vibration waveforms to analyze the coupling relationship of multi-dimensional blasting parameters, and explore a relating law of the multi-dimensional blasting parameters, furthermore, the target millisecond is solved and related to the control strategy of millisecond blasting, the control strategy of millisecond blasting can be used for tunneling projects, and it is beneficial for controlling a blasting vibration intensity, and reducing a damage of blasting vibration to buildings, so as to achieve a reasonable millisecond time control. The disclosure establishes the millisecond blasting model by acquiring the physical and mechanical parameters, an applicability of project is fully considered, the top of the explosive model is constrained by a restraint condition set based on the vertical stress of a ground building, an influence of ground stress is considered, and the model has high fit and strong applicability.

The above contents are merely the embodiments of the disclosure, common knowledge such as well-known specific structures and characteristics in the embodiments are not described in detail here, those skilled in the art should understand that the scope of protection of the disclosure is not limited in the embodiments obviously. Without departing from the disclosure, multiple modifications and improvements can be made, which should also be considered as the scope of protection of the disclosure, and these will not affect effectiveness of implementation of the disclosure or a practicality of the patent.

What is claimed is:

1. A millisecond time control method for excavation blasting of a tunnel, comprising:

step 1: acquiring physical and mechanical parameters of a rock on an excavation working surface of the tunnel, establishing a millisecond blasting model according to the physical and mechanical parameters, and designing four different dimensions of blasting parameters of explosive quantity, a hole number, an inter-hole millisecond, and an inter-row millisecond;

step 2: simulating, based on the millisecond blasting model, a blasting process of an explosive package in the tunnel using the blasting parameters, to obtain a blasting vibration curve;

step 3: obtaining single-hole blasting vibration waveforms of the tunnel, and solving a vibration synthesis curve according to the single-hole blasting vibration waveforms of the tunnel by using a vibration synthesis theory;

step 4: comparing the vibration synthesis curve with the blasting vibration curve to obtain a coupling relationship of the blasting parameters, comprising:

performing mode decomposition on the vibration synthesis curve and the blasting vibration curve; and calculating information gains of decomposed vibration signals, and using the information gains as coupling coefficients to obtain a coupling relationship matrix; and step 5: screening out a target blasting parameter set based on the blasting vibration curve of the step 2 and using a safety vibration velocity as a restraint condition, and determining a target group of a single-hole explosive quantity and the hole number according to a size of the excavation working surface of the tunnel and the target blasting parameter set;

obtaining a vibration synthesis curve corresponding to the target group of the single-hole explosive quantity and the hole number, and reconstructing the vibration synthesis curve corresponding to the target group of the single-hole explosive quantity and the hole number by using the coupling relationship matrix, to obtain a blasting fitting curve; and analyzing, based on an interference vibration reduction theory with an effect subtraction in a half main waveform period, a blasting vibration attenuation law of different combinations of inter-hole milliseconds and inter-row milliseconds, to determine a target millisecond, and determining a control strategy for millisecond blasting based on the target millisecond.

2. The millisecond time control method for excavation blasting of a tunnel as claimed in claim 1, wherein the physical and mechanical parameters comprise a rock density, a uniaxial compression strength, a Poisson's ratio, and an elastic modulus.

3. The millisecond time control method for excavation blasting of a tunnel as claimed in claim 2, wherein the establishing a millisecond blasting model, comprises:

establishing an explosive model, a rock model, and an air composition material model by using an ANSYS software;

wherein a size of the explosive model is 8 centimeters (cm)×12 cm×1000 cm, a size of the rock model is 5 meters (m)×10 m×15 m; and wherein a surface of the explosive module in contacted with the rock model is constrained by a symmetrical plane constraint condition, a side face of the explosive model is constrained by a non-reflecting boundary condition; and wherein a top of the explosive model is constrained by a restraint condition set based on a vertical stress of a ground building.

4. The millisecond time control method for excavation blasting of a tunnel as claimed in claim 3, wherein the designing four different dimensions of blasting parameters of an explosive quantity, a hole number, an inter-hole millisecond, and an inter-row millisecond, comprises: obtaining groups of the four dimensions of blasting parameters by using a response surface methodology.

5. The millisecond time control method for excavation blasting of a tunnel as claimed in claim 4, wherein the step 2 comprises:

simulating a rock and air by using a Lagrange method, and simulating an explosive movement by using any one of Lagrangian-Eulerian methods;

simulating an explosion field by using a motion equation of inviscid compressible fluid; and obtaining vibration velocities of a plurality of observation points of the millisecond blasting model, and performing numerical simulation calculation on the vibration velocities to obtain the blasting vibration curve.

6. The millisecond time control method for excavation blasting of a tunnel as claimed in claim 5, wherein the step 3 comprises:

fitting the single-hole blasting vibration waveforms to obtain a single-hole waveform fitting function, wherein a formula of the single-hole waveform fitting function is as follows:

$$f(t) = a_0 + \sum_{i=0}^{k}(a_i \cos i\omega t + b_i \sin i\omega t;$$

extending the single-hole waveform fitting function based on a single-hole waveform truncation time to obtain a time domain waveform fitting function, wherein a formula of the time domain waveform fitting function is as follows:

$$v(t) = \begin{cases} 0 & t < 0 \\ f(t) & 0 \le t \le T \\ 0 & T < t \end{cases};$$

wherein f(t) represents the single hole waveform fitting function, t represents time, $a_0$, $a_i$, and $b_i$ represent fitting coefficients, ω represents a fundamental frequency, k represents a fitting series, a curve fitting calculation is controlled by the fitting series k, a value of k is adjusted according to a waveform fitting accuracy, v(t) represents the time domain waveform fitting function, and T represents the single-hole waveform truncation time; and performing a linear superposition calculation on the groups of the four dimensions of blasting parameters to obtain the vibration synthesis curve.

7. The millisecond time control method for excavation blasting of a tunnel as claimed in claim 6, wherein the control strategy for millisecond blasting comprises:

adopting a segmented millisecond blasting technology when one of $t_1>\gamma_1$, and $t_2>\gamma_2$ or $t_1<\gamma_1$, and $t_2<\gamma_2$ is satisfied; and adopting a continuous charge millisecond blasting technology when one of $t_1>\gamma_1$, and $t_2<\gamma_2$ or $t_1<\gamma_1$, and $t_2>\gamma_2$ is satisfied.

8. The millisecond time control method for excavation blasting of a tunnel as claimed in claim 7, wherein in a situation that the segmented millisecond blasting technology is adopted, an interval charging manner is used for a blast hole, an explosive is divided into two sections for charging with the two-section explosives having a same length, the two-section explosives are delay-blasted by a digital electronic detonator in different time periods, and a blasting time of a lower section of the two sections is delayed by 5-10 milliseconds (ms) compared to an upper section of the two sections; and wherein in a situation that the continuous charge millisecond blasting technology is adopted, a diameter of the explosive is smaller than a diameter of the blast hole, a gap is defined between the explosive and a wall of the blast hole, the explosive is continuously loaded into the blast hole and is not separated, and the explosive is delay-blasted by the digital electronic detonator.

* * * * *